US005439274A

United States Patent [19]

Krueckl

[11] Patent Number: 5,439,274

[45] Date of Patent: Aug. 8, 1995

[54] ROTARY MINE BORING HEAD HAVING MOVABLE LINKS WITH CUTTER BITS

[75] Inventor: Edward Krueckl, Saskatoon, Canada

[73] Assignee: Prairie Machine & Parts Mfg. Ltd., Saskatoon, Canada

[21] Appl. No.: 132,993

[22] Filed: Oct. 6, 1993

[30] Foreign Application Priority Data

Oct. 8, 1992 [CA] Canada ..... 2080217

[51] Int. Cl.[6] ..... E21B 10/62; F21C 27/24

[52] U.S. Cl. ..... 299/59; 299/80; 299/85

[58] Field of Search ..... 299/55, 57, 59, 61, 299/80, 85

[56] References Cited

U.S. PATENT DOCUMENTS

| | | | |
|---|---|---|---|
| 1,409,354 | 3/1922 | Addington | 408/25 |
| 2,733,057 | 1/1956 | Letts | 299/57 |
| 2,796,244 | 6/1957 | Gonski | 299/57 |
| 2,823,023 | 2/1958 | Hlinsky | 299/57 |
| 3,086,761 | 4/1963 | McWhorter | 299/57 |
| 3,407,006 | 10/1968 | Brill et al. | 299/59 |
| 3,428,363 | 2/1969 | Drescher et al. | 299/57 |
| 3,459,453 | 8/1969 | Brill et al. | 299/80 X |
| 3,523,711 | 8/1970 | McCleery | 299/80 X |
| 3,827,754 | 8/1974 | Gilley | 299/30 |
| 4,615,565 | 10/1986 | Schupphaus | 299/75 |

FOREIGN PATENT DOCUMENTS

| | | |
|---|---|---|
| 1151680 | 8/1983 | Canada . |
| 1153025 | 8/1983 | Canada . |

*Primary Examiner*—David J. Bagnell
*Attorney, Agent, or Firm*—Bliss McGlynn

[57] ABSTRACT

A continuous mining machine having a cutter frame with two rotary boring heads mounted on this frame for rotation about axes extending longitudinally of the machine. Each boring head has a plurality of radially extending rotor arms which carry and support cutter bits on the front thereof. A pair of reciprocating pole devices are mounted in each of the rotor arms for movement in the radial direction of the arm. A number of link members are each pivotally connected at opposite ends thereof to respective pair of the pole devices and additional cutter bits are mounted on the link members. There is also a cam mechanism for reciprocating each pair of pole devices as the boring heads are rotated. The cam mechanism causes each pair of pole devices to be pushed radially outwardly at each of the four corners distributed about a circular hole cut by the respective boring head in such a manner that the resulting hole bored by the machine is generally rectangular. Preferably, each pair of pole devices has rollers mounted thereon and each rotor arm has tracks mounted therein, on which the rollers run. The preferred mining machine includes a mobile frame with a longitudinal conveyor mounted on this frame having a forwardly open throat adjacent floor level.

28 Claims, 12 Drawing Sheets

ROTARY MINE BORING HEAD HAVING MOVABLE LINKS WITH CUTTER BITS

BACKGROUND OF THE INVENTION

This invention relates to continuous mining machines that employ rotary boring heads.

There are commonly used in the mining industry, continuous mining machines of the boring type which include a mobile frame and a plurality of boring heads mounted thereon. These heads are rotatable about parallel axes and cut a plurality of contiguous bores at the front of the machine. Typically, there are two boring heads or rotors which rotate in opposite directions in such a way as not to interfere with each other but machines with more than two rotors are also known. The machine is usually driven with caterpillar like tracks. In one known machine, the mobile frame is provided with both front tilt cylinders and rear tilt cylinders with both sets of cylinders connected at one end to an upper frame which houses the main gear box, main electric motors and the rotating boring heads. With the use of these cylinders, it is possible to change the direction of the cutting heads, moving them either upwardly or downwardly. The mined material that is cut by the boring heads is conveyed up the centre of the machine with a drag type conveyor. The two rotors are able to cut this material by means of cutting bits mounted on the front of the rotor arms.

One difficulty with this type of boring machine is that the rotating heads leave both downwardly extending and upstanding cusps that are between the boring heads as the machine is advanced. Some method must be provided to trim or cut off these cusps. In one well known continuous mining machine, there is mounted behind the two rotors and in front of the gear box two steel bars, one at the top of the rotating heads and the other at the bottom. On these bars are mounted steel glides along which a trim chain runs. Cutting bits are mounted on this trim chain so as to face the front and cut off the cusps, leaving flat areas at the top and bottom of the bore. The aforementioned bars can be retracted with cylinders which are mounted to the main gear box. The trim chain is driven by a sprocket which is driven from the main gear box.

Problems have been encountered in the past with the aforementioned trim chains because they have high maintenance costs. Although a trim chain typically cuts less than 10% of the face, the trim chain maintenance costs could be as much as 45% of the total cost of maintaining the boring machine. An annual trim chain maintenance on a single boring machine may amount to $80,000.00 Cdn. and these costs do not include lost production and indirect costs.

Also each trim chain in a mining machine is known to require approximately 200 horse power in order to run the chain along its continuous path which includes sprockets and rigid guides. Thus, a tremendous amount of power is required to operate both bottom and top chains while advancing the bore through the ore at even the relatively slow rate of 12" per minute.

It will be appreciated that it is highly desirable to reduce the mechanical breakdown time of a mine boring machine as much as possible. Each time a borer breaks down, all production from the area of operation of the machine stops and a delay from a breakdown can easily last from one to four hours. Because of the frequency of the breakdowns, there is a great amount of frustration on the part of the operators and supervisors, which frustration can lead to low moral.

U.S. Pat. No. 3,086,761 issued Apr. 23, 1963 to *Goodman Manufacturing Co.,* describes a boring type continuous miner with two rotating boring heads, each having three rotating arms. The arms have radially spaced cutter supports projecting forwardly therefrom and carrying the usual cutter bits. This machine has a conveyor extending therealong from a position adjacent the ground rearwardly of a support for a lower trimmer bar. There is also an upper trimmer bar extending between the boring heads and forming a guide for a trimmer cutter chain. The upper bar is mounted on a frame for vertical adjustment by means of hydraulic jacks. The lower trimmer bar is also adjustably mounted on the frame by means of laterally spaced fluid pressure jacks. The cutter chain is guided for movement along the upper and lower trimmer bars and it is trained about corner sprockets at opposite ends of the upper bar. There are also corner sprockets at opposite ends of the lower trimmer bar.

In another version of a boring type mining machine disclosed in U.S. Pat. No. 2,823,023, which issued Feb. 11, 1958 to *Goodman Manufacturing Company,* there is an auxiliary frame mounted by suitable jacks at the front end of a main frame. There are a pair of boring heads which project forwardly from the auxiliary frame and which rotate on laterally spaced axes. In order to cut the bottom cusp formed by the boring heads, there is a lower trimmer bar which is rotatable on a horizontal axis and journaled near opposite ends thereof. This trimmer bar is located in front of the auxiliary frame and rearwardly of the path of movement of the two boring heads. An upper cutter bar is mounted in a similar manner at the upper limits of movement of the boring heads. Cutter bits are mounted on the spiral ribs formed on the two cutter bars.

It is an object of the present invention to provide an improved continuous mining machine with two rotary boring heads having a plurality of radially extending rotor arms with each rotor arm having mounted therein a pair of reciprocating pole devices which are connected together by means of a link member on which cutter bits are mounted. A cam mechanism is provided to reciprocate the pole devices as the boring heads are rotated. This mechanism causes each pair of pole devices to be pushed radially outwardly at each of four corners distributed about a circular hole cut by the respective boring head in such a manner that the resulting hole bored by the machine is generally rectangular.

It is a further object of the invention to provide a continous mining machine that avoids the need for trim chains and having reduced maintenance costs. Because of the decrease in the downtime for maintenance, the production capability of the machine is increased.

SUMMARY OF THE INVENTION

According to one aspect of the invention, there is provided in a continuous mining machine a cutter frame, two rotary boring heads mounted on this frame for rotation about axes extending longitudinally of the machine, each boring head having a plurality of radially extending rotor arms which carry and support cutter bits on the front thereof, and a pair of reciprocating pole devices mounted in each of the rotor arms for movement in the radial direction of the arm. A number of link members are each pivotally connected at opposite ends thereof to a respective pair of the pole devices. Additional cutter bits are mounted on these link members. A cam mechanism reciprocates each pair of pole devices as the boring heads are rotated. This cam mechanism causes each pair of pole devices to be pushed radially outwardly at each of four corners distributed about a circular pole cut by the respective boring head in such a manner that the resulting hole bored by the machine is generally rectangular.

Preferably each pair of pole devices has rollers mounted thereon and each rotor arm has tracks provided therein on which the rollers run.

According to another aspect of the invention, a continuous mining machine comprises a mobile frame, a longitudinal conveyor mounted on this frame having a forwardly open throat adjacent the floor level, and a support frame for boring heads mounted on the mobile frame. There are at least two rotary boring heads mounted on the support frame so as to rotate about spaced parallel axes in order to cut contiguous bores in advance of the machine. Each boring head has at least one rotor arm which carries and supports cutter bits on the front thereof. A pair of reciprocating poles are mounted in each rotor arm for movement in the radial direction of the arm. Link members are each pivotally connected at opposite ends thereof to a respective pair of the poles and cutter bits are mounted on each link member. A cam follower is mounted on each reciprocating pole and a generally flat cam structure is mounted on the support frame behind each boring head. This structure has a continuous, lobed track formed in the front thereof. The cam followers move along this track and cause each pair of poles to be pushed radially outwardly at each of several corners distributed about a circular hole cut by the respective boring head in such a manner that the resulting hole bored by the machine has generally flat sides.

Further features and advantages of the present mining machine will become apparent from the following detailed description taken in conjunction with the accompanying drawings.

DETAILED DESCRIPTION OF PREFERRED EMBODIMENT

Figure 1:
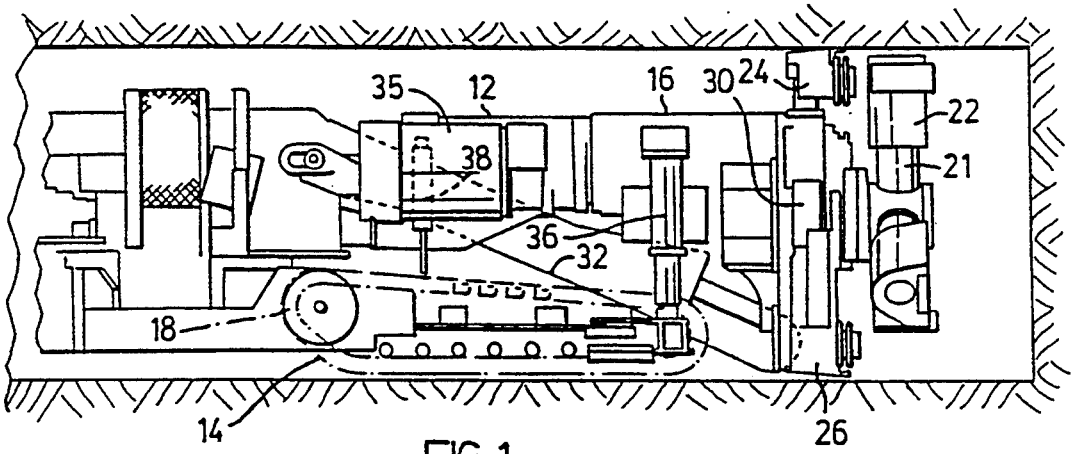
FIG. 1 (PRIOR ART)
FIG. 1 is a side elevation of a known continuous mining machine with two rotary boring heads.
Figure 2:
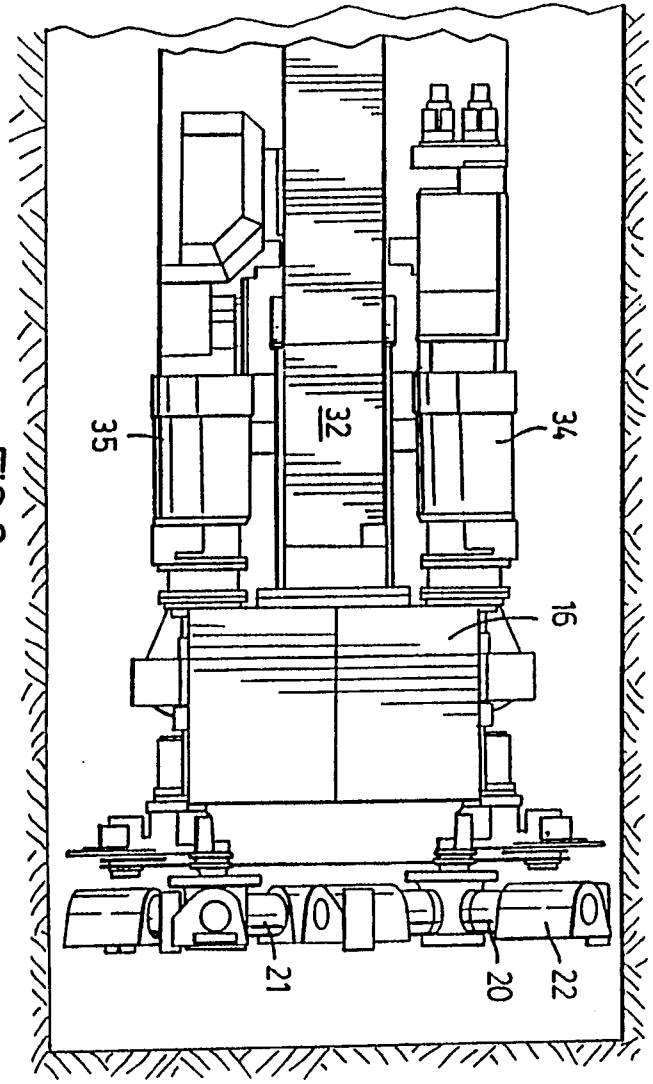
FIG. 2 (PRIOR ART)
FIG. 2 is plan view of the mine boring machine of FIG. 1, which view does not include the rear portion of the conveyor assembly.

FIGS. 1 and 2 of the drawings show a known continuous mining machine employing two rotating boring heads at the front of the machine. One such known machine is known as the 780 Marietta Miner. This machine includes a main frame assembly 12, a track frame assembly 14 and a main gear case assembly 16. The track frame assembly includes right and left caterpillar tracks 18 which provide the required mobility to the machine and can be used to steer the machine. Mounted at the front of the machine is a rotor arm assembly which includes left and right rotary boring heads 20 and 21. These heads are mounted to rotate about axes extending longitudinally of the machine. In the illustrated machine, each head has three radially extending rotor arms 22 which carry and support cutter bits on the front thereof. This known mining machine also has a top bar assembly 24 and a bottom bar assembly 26 which movably support a continuous or endless chain. This chain, which contains from 66 to 88 carbide tip bits, together with the top and bottom bar assemblies, is replaced by the present invention.

It will be understood that at the front of the illustrated mining machine of FIG. 1 there are cylinders indicated at 30. These cylinders extend in advance of the gear box and they are mounted on the gear box for vertical adjustment with respect thereto and for angular adjustment about axes extending transversely of the main frame.

The two rotary boring heads 20 and 21 cut contiguous bores in a mine face and leave downwardly extending and upwardly extending cusps on the mine floor and mine roof. The modified and improved rotary boring heads of this invention substantially eliminate these cusps so that a substantially rectangular bore or passageway is formed by the machine.

This known machine also has a longitudinal conveyor mounted on the main frame and having a forwardly opening throat adjacent the floor level. This conveyor 32 slopes upwardly and rearwardly and conveys the mined material to the rear of the machine. The rear of the conveyor assembly is not shown as it forms no part of the present invention.

The two boring heads are rotated by left and right rotor motors 34 and 35. Mounted to the front end of the track frame assembly and located on each side of the main gear case is a front tilt cylinder 36. There is also a rear tilt cylinder 38 located inwardly of each rotor motor. These front and rear cylinders can be used to tilt the cutter frame upwardly or downwardly in order to change the direction of the tunnel being bored.

Figure 3:
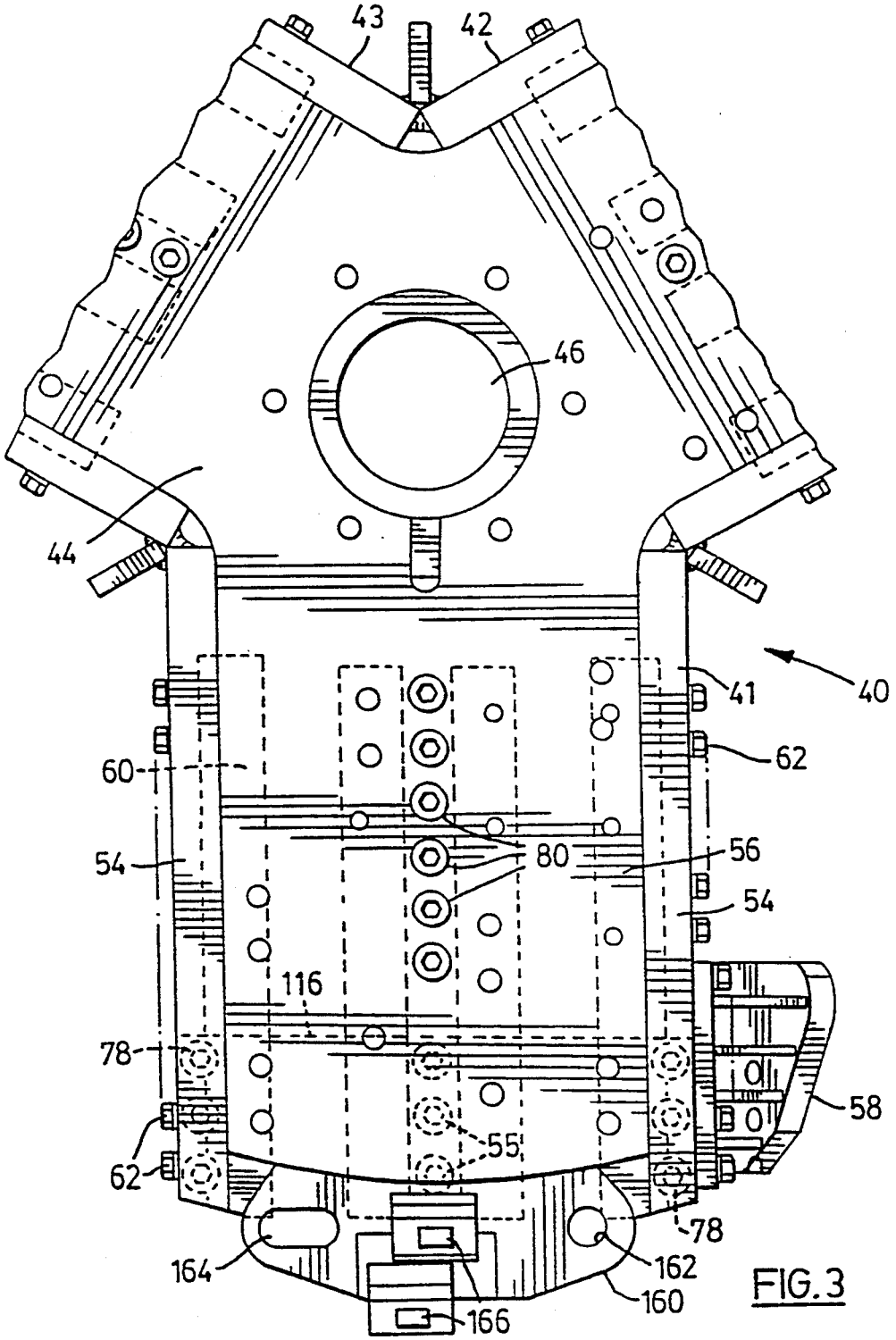
FIG. 3 is a front view of the central hub and one rotor arm of a boring head constructed in accordance with the invention.
Figure 4:
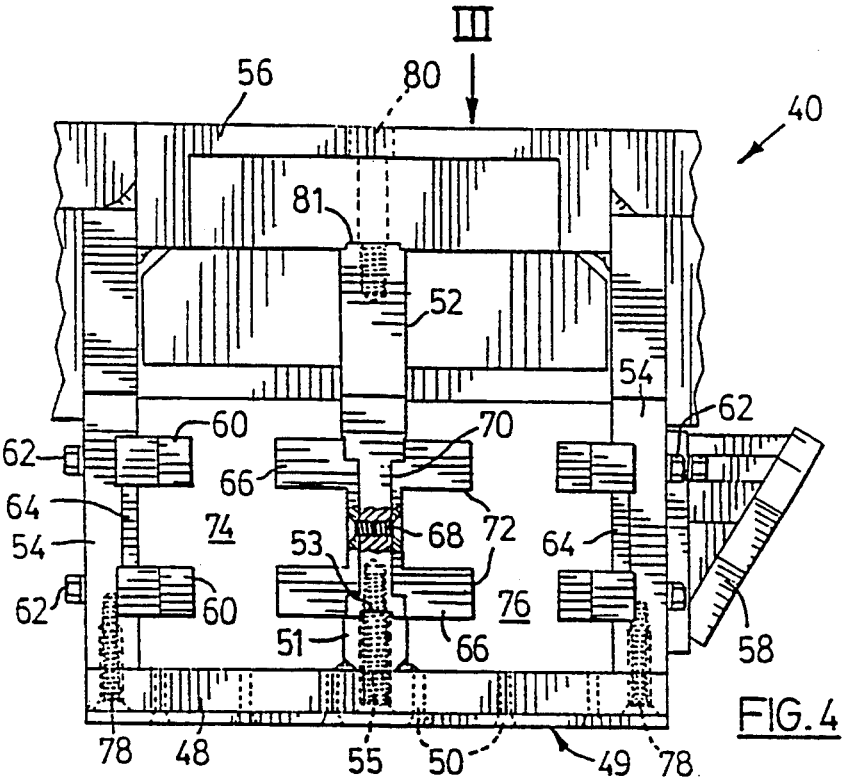
FIG. 4 is an outer end view of the rotor arm shown in FIG. 3.

Turning now to the construction of each of the two boring heads of the machine of the invention, a portion of the right hand boring head 40 is shown in FIG. 3. It will be understood that the left hand boring head is constructed in a similar fashion but in the opposite manner as it will rotate in the opposite direction. The right hand head of FIG. 3 rotates counterclockwise. The boring head 40 has three rotor arms 41 to 43 but only the arm 41 is shown in its entirety for ease of illustration. Each of the arms extends outwardly from a central hub indicated at 44. In the centre of the rotor is a circular hole 46 which receives a drive shaft connected in a known manner to the rotor motor 35. As shown in FIG. 4, the back of each arm is provided by a support plate 48 which is preferably protected by a wear plate 49 that is bolted to the exterior surface of the support plate. A number of bolts 50 can be used to detachably connect the wear plate 49. Welded to the centre of the support plate and extending longitudinally is a connector block 51 with a connecting key 53 formed on its front surface. A central wear bar mount 52 is detachably connected to the block 51 by means of three bolts 55. Extending along opposite sides of the support plate and perpendicular thereto are two sidewall plates 54. These plates 54 extend generally radially from the hub of the boring head and, as indicated in FIG. 3, they are welded at their inner ends to the adjacent sidewall plate of the adjacent arm. Mounted at the front or top ends of the plates 54 is a front cover member 56. On this member 56 are mounted sets of steel plates carrying a large number of cutting bits on the outer or front surface thereof in a known manner. These plates which have not been illustrated in the drawings are of known construction and do not form part of the present invention.

Bolted to the leading side plate 54 adjacent the outer end thereof is a rotor end plough 58. This plough which slopes inwardly and rearwardly as shown in FIG. 4 acts to push the granular material that has been cut by the boring head to the rear of the rotor arm. Also mounted on the side plates 54 are rotor arm wear bars 60 of which there are four in each rotor arm. There are two spaced-apart wear bars 60 connected by bolts 62 to the inside surface of each plate 54. The bolts 62 are distributed evenly along the length of the wear bar. Each support plate 54 is preferably formed with an elongate recess 64 which is shaped to receive and locate the two wear bars 60. Also mounted to the mount 52 are two channel wear bars 66, each of which is bolted at 68. The centre mount 52 is recessed on both sides at 70 to locate the wear bars 66 in the proper position. Each wear bar 66 has two spaced apart sides 72 which form two roller tracks. These tracks are directly opposite tracks formed by the aforementioned wear bars 60. It will be seen that the plates on the four sides of each rotor arm form a central channel which extends longitudinally thereof. This channel is divided into two elongate channel sections indicated at 74 and 76 by the centrally located wear bars 66 and their mounting plate 52. It will be appreciated that it is in these channel sections that the reciprocating pole devices of the invention move inwardly and outwardly as explained further hereinafter. In order that one can gain access to these channel sections, it is possible to detach the rear edges of the sidewall plates 54 from the support plate 48 and to detach the central mounting plate 52 from the front cover 56. The rear edges of the plates 54 are connected to the support plate 48 by means of three bolts 78. The cover member is connected to the mount 52 by means of six bolts 80 that thread into the front edge of the mount. It should also be noted that an elongate key 81 is formed in the forward edge of the plate 52 and this provides a keyed connection to the front cover 56 as well.

Figure 6:
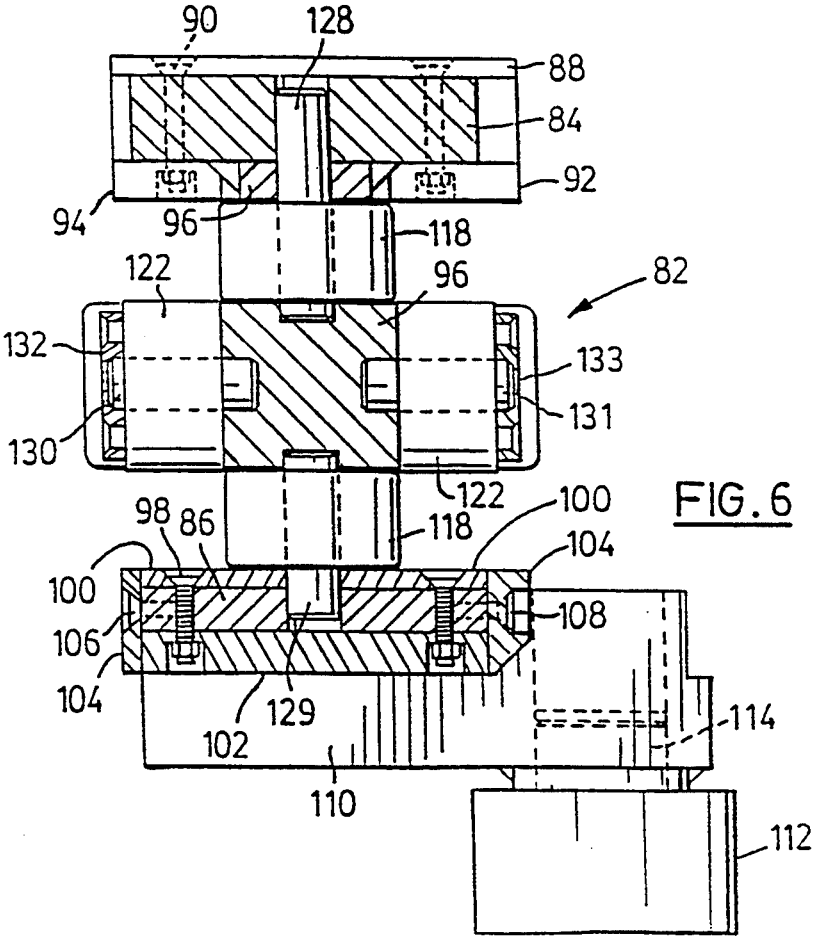
FIG. 6 is a transverse cross-sectional view taken along the line VI—VI of FIG. 5.
Figure 5:
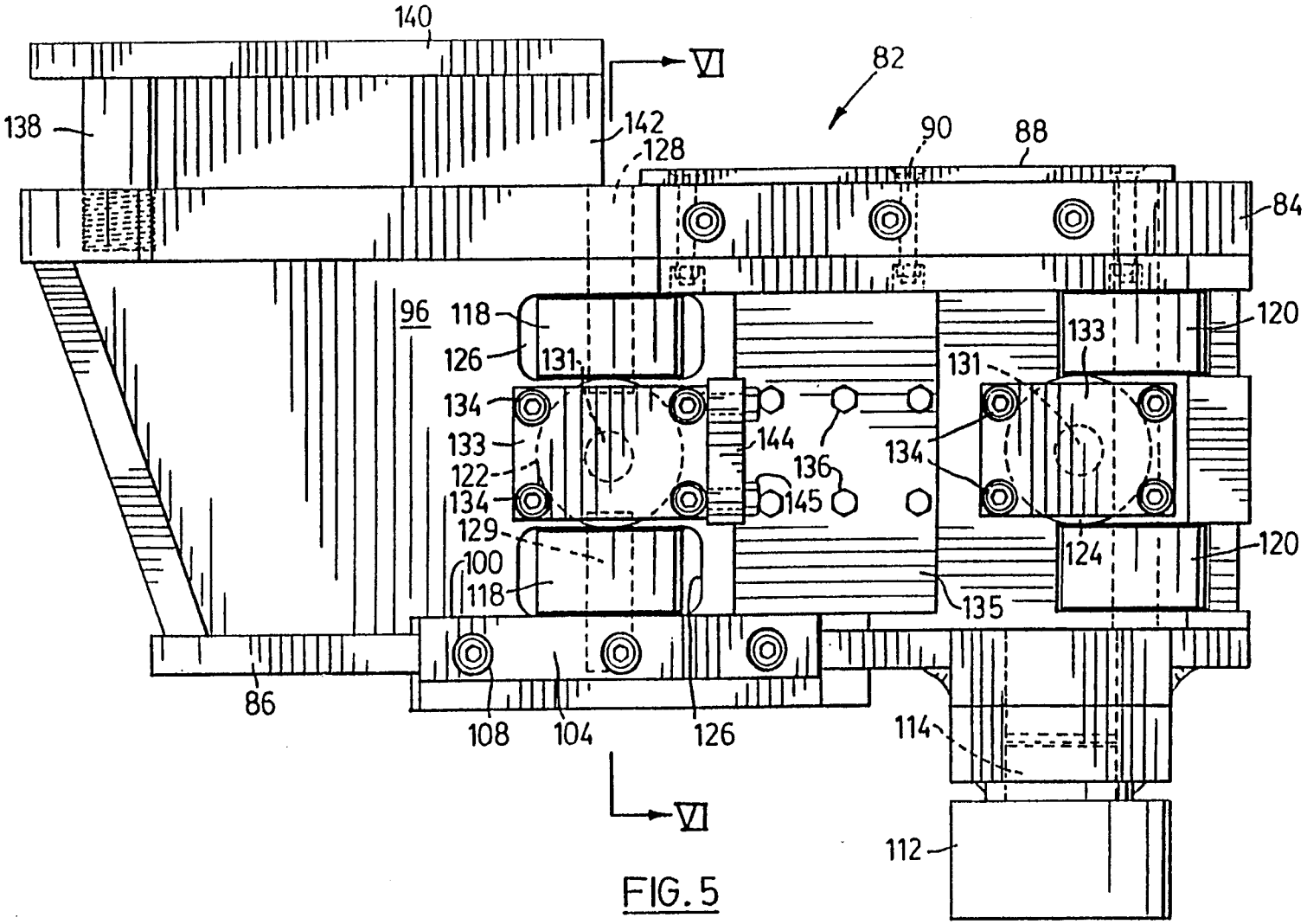
FIG. 5 is side view of a trailing pole device used in the rotary boring head of the invention.
Figure 7:
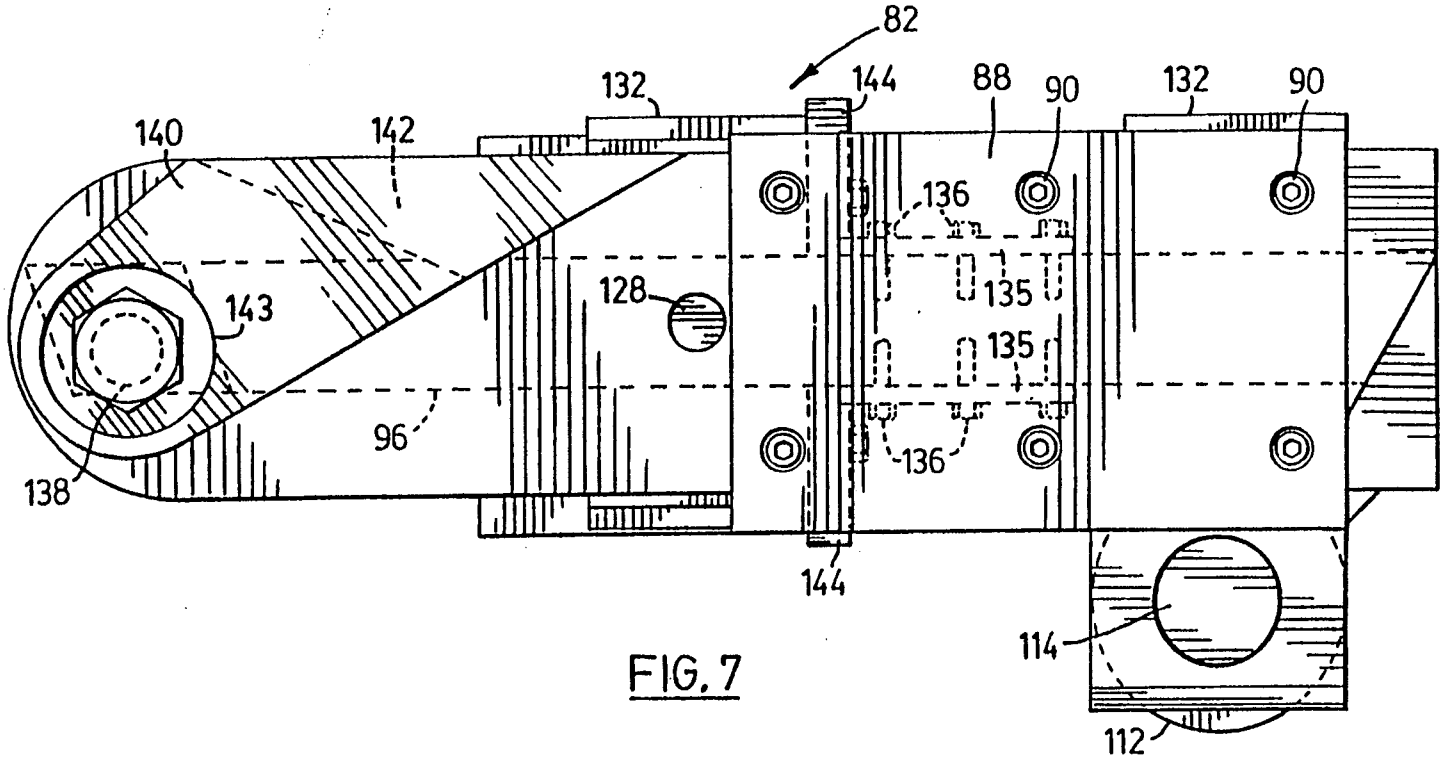
FIG. 7 is a plan view of the trailing pole device of FIG. 5.

Reference will now be made to the trailing pole device or push pole of the invention which is illustrated in FIGS. 5 to 7 of the drawings. The trailing pole device 82 includes an upper plate 84 and a thinner, lower plate 86. A wear bar 88 in the form of a flat brass or hard plastic plate is connected by means of bolts 90 to the upper plate. Also connected to the upper plate are two further wear bars 92 and 94 which are connected to the bottom surface of the upper plate by means of the same bolts 90. A relatively thick connecting plate 96 extends between the centre axes of the upper and lower plates 84 and 86 and rigidly connects these plates. Mounted on the top surface of the lower plate 86 by means of bolts 98 are two elongate wear bars 100. The bolts 98 also connect a larger wear bar 102 to the bottom surface of the lower plate 86. The edges of these wear bars and also the lower plate 86 are further covered by elongate wear bars 104 that are detachably connected by means of short bolts 106 and 108.

Connected to the inner end of the lower plate 86 is a mounting block 110 to which a track roller 112 is rotatably connected. The track roller is mounted on a stub shaft 114 which extends into an opening in one end of the block 110. It will be understood that the track roller 112 is a cam follower which engages the lobed track of a cam structure described hereinafter. It will further be understood that each track roller 112 projects rearwardly of the support plate 48 when the pole device is mounted in the rotor arm. In this regard, it will be noted that the support plate 48 extends radially inwardly at the rear of the support arm only to an inner edge indicated by dashed line 116 in FIG. 3. In this way the rear of the arm is left open to an extent that permits the required movement back and forth of the track rollers 112.

The trailing pole device 82 has four pairs of rollers mounted thereon for guiding the pole device along the aforementioned wear bars 60 and 66. In particular, there are two pairs of rollers 118 and 120 whose axes extend perpendicularly to the front side of the pole device and there are also two further pairs of rollers 122 and 124 whose axis are parallel to the front side and perpendicular to the longitudinal axis of the pole device. The rollers in each of these pairs are axially aligned and spaced apart. The rollers 118 and 120 are each centred in an opening 126 cut in the connecting plate 96. These rollers rotate about shafts 128/129 that extend into the upper and lower plates and through the connecting plate 96. The other rollers 122 and 124 are mounted on short pins 130 and 131, the inner ends of which are supported in circular openings drilled into the connecting plate 96. The outer ends of the pins 130 and 131 are supported by brackets 132 and 133. These brackets include rectangular end plates that are bolted by four bolts 134 to connecting brackets disposed on opposite sides of the respective roller. It should also be noted that between the rollers 122 and 124 there are mounted on each side of the connecting plate 96 two further rectangular wear bars 135 which are detachably connected by bolts 136.

Mounted on top of the upper plate 84 is a connecting pin 138 and pin support plate 140. The pin 138 is used to connect a link member described hereinafter to the pole device. The plate 140 is rigidly connected to the upper plate 84 by means of a triangular connecting block 142. The head of the pin 138 is located in a circular recess 143 located in the upper surface of plate 140. The pin 138 is connected by threads to the upper plate 84.

An additional wear bar 144 is preferably connected by bolts 145 to the inner surface of the bracket arrangement that supports the roller 122. It will be understood that the wear plate 49 and the various wear bars, including bars 92, 94, 100, 102, 104, 135 and 144 are made of brass or very hard plastic and act as a seal to prevent muck from getting into the mechanism and the track.

Figure 8:
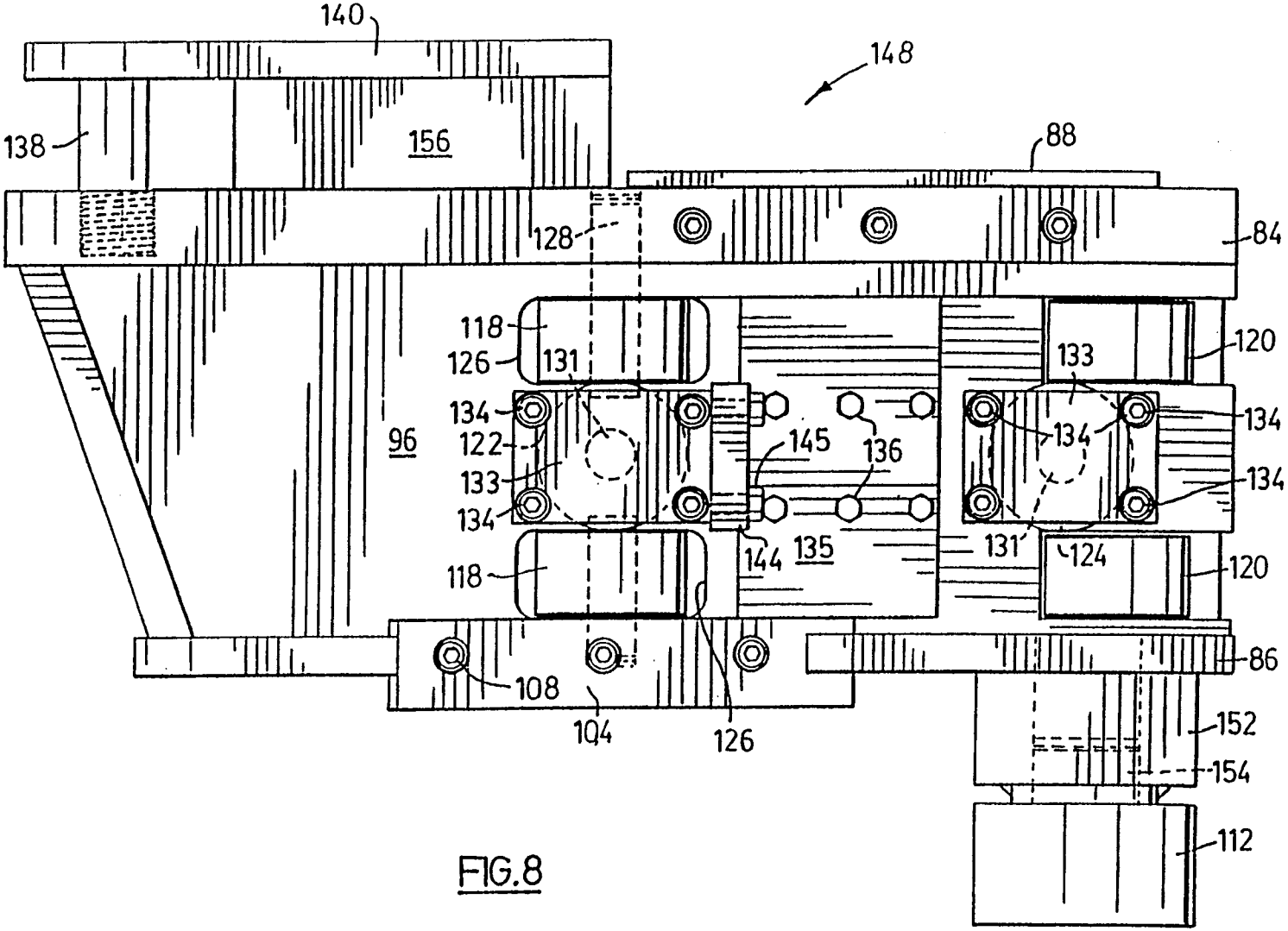
FIG. 8 is a side view of a leading pole device used in the rotary boring head of the invention.
Figure 9:
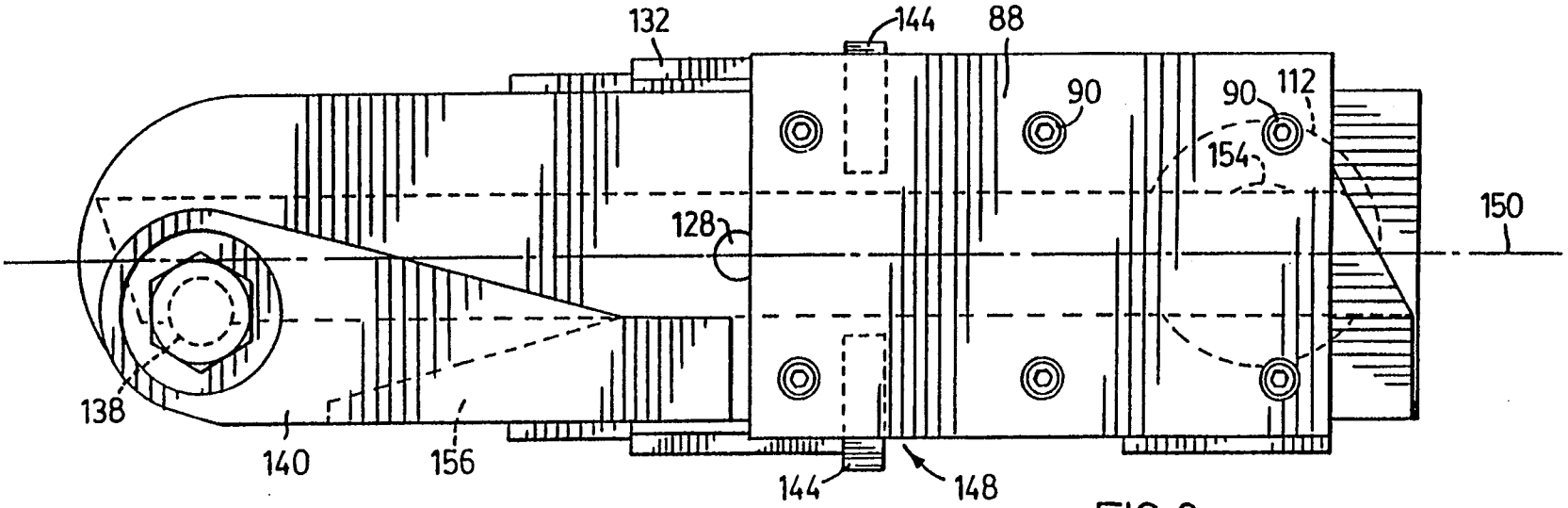
FIG. 9 is a plan view of the pole device of FIG. 8.

The leading pole device 148 will now be described with reference to FIGS. 8 and 9 of the drawings. It will be understood that the leading pole device or push pole has many features and parts in common with the trailing pole device 82. In FIGS. 8 and 9 the same reference numbers have been used to indicate those features which are the same as features in the trailing pole device. The present description will be confined largely to those aspects of the leading pole device which differ from the construction of the trailing pole device. In the leading pole device, the track roller 112 has its centre axis very close to the longitudinal centre axis 150 of the pole device. It is rotatably mounted in mounting block 152 which is welded to the bottom plate 86. The block 152 has a circular opening to receive stub shaft 154.

In this pole device, the pin support plate 140 is connected to the upper plate by connecting block 156. This block is mounted on the opposite side of the upper plate as compared to the connecting block 142.

Each pair of trailing and leading pole devices is connected together by a link member 160, one of which is shown in FIG. 3. The link member comprises a rigid, generally triangular plate having a circular hole 162 in its leading corner and an elongate hole or slot 164 in a trailing corner. It will be understood that the connecting pin 138 of the leading pole device extends through hole 162 while the connecting pin 138 of the trailing pole device extends through slot 164. Mounted on the front surface of each link member are two or more cutting bits 166. These cutting bits are of standard construction and are similar to those mounted on plates in front of the rotor arm. It is the cutting bits 166 which are so manoeuvred that the bore hole left by the rotary boring heads of the invention is generally rectangular. A cam mechanism is used to push each link member 160 out so that the cutting bits mounted thereon are pointing in the direction that they are cutting.

Figure 10:
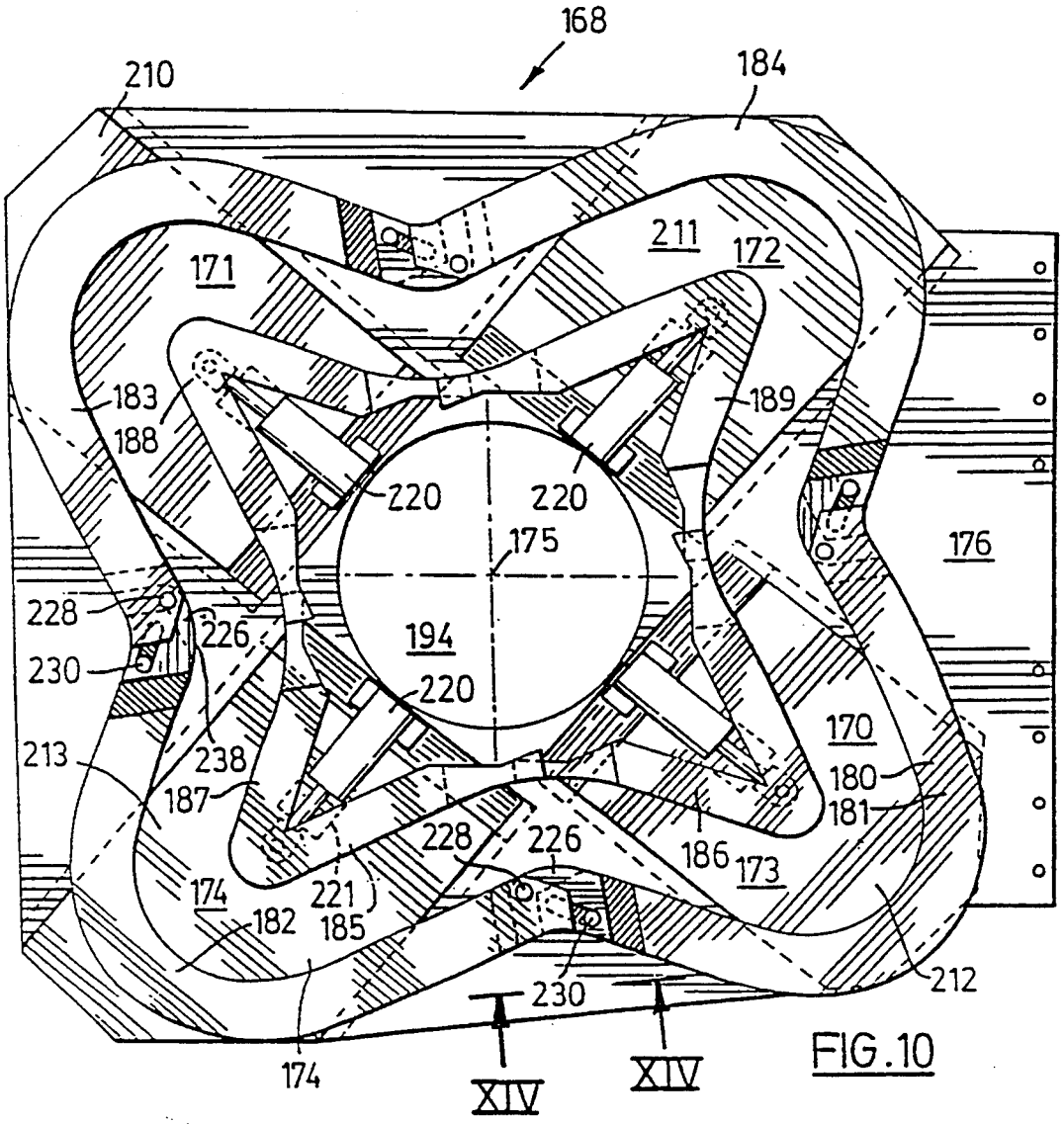
FIG. 10 is a front view of the base plate and track assembly which forms the cam mechanism for moving the pole devices inwardly and outwardly, the four lobes of the track being shown in the extended position.
Figure 11:
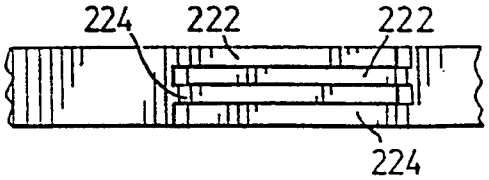
FIG. 11 is a sectional detail showing the interlocking finger arrangement where two inner track lobe sections meet.
Figure 12:
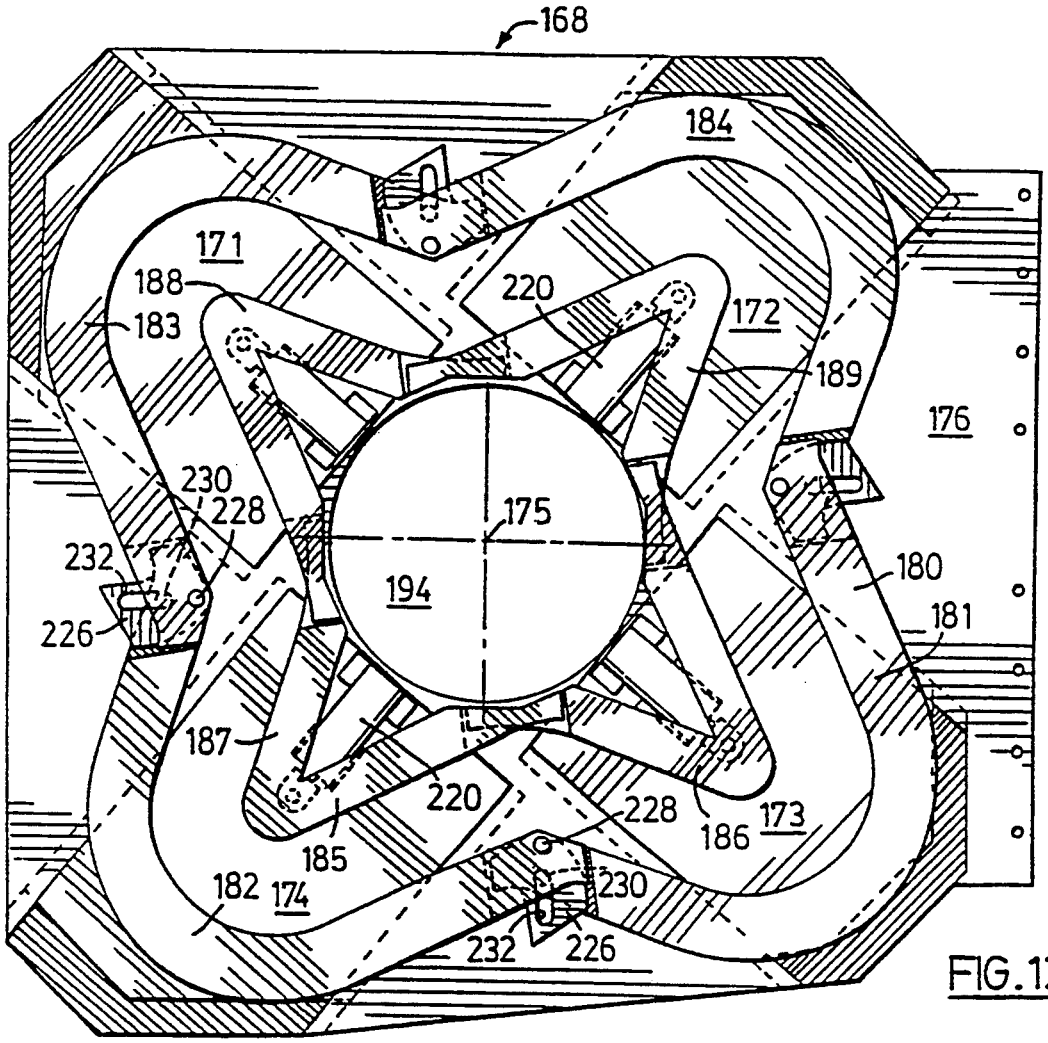
FIG. 12 is a front view similar to FIG. 10 but showing the four lobes of the track in the retracted position.
Figure 13:
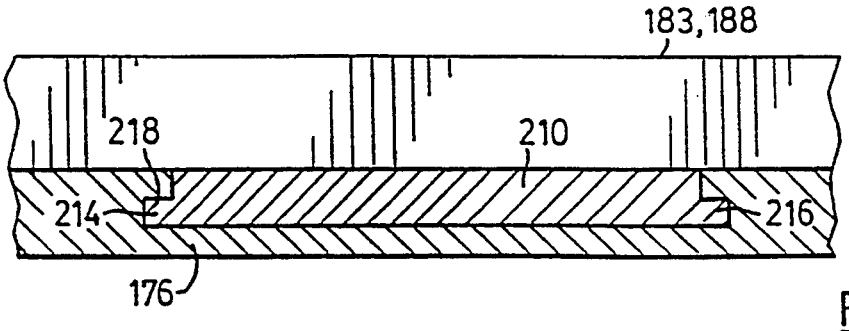
FIG. 13 is a sectional detail showing the manner in which a movable support plate to which an inner and an outer track lobe section are connected is joined to a base plate.

The cam means or cam mechanism for reciprocating each pair of pole devices as the boring heads are rotated is illustrated in FIGS. 10 to 14 of the drawings. This cam mechanism indicated generally at 168 causes each pair of pole devices to be pushed radially outwardly at each of four corners distributed about a circular hole cut by the respective boring head. The cam mechanism is a generally flat cam structure having a continuous four lobed track 170 formed in the front thereof. The four lobes are indicated at 171 to 174 and they are substantially evenly distributed about centre point 175. Although the right hand track is shown in FIG. 10, it will be understood that the left hand track is similar in its construction but is opposite to the right hand track shown. The cam mechanism includes a base plate 176. Mounted on the base plate 176 in the manner illustrated in FIGS. 10 and 13 are four movable sections 210 to 213, on each of which is mounted or arranged an inner lobe portion 186 to 189 and an outer lobe portion 181 to 184. The inner lobe portions form a continuous inner track indicated at 185 while the outer lobe portions, together with four links described hereinafter form a continuous outer track 180. Each of the four sections 210 to 213 is formed with longitudinally extending flanges 214 and 216 along their side edges and these flanges fit snugly in undercut grooves 218 formed in the base plate 176 (see FIG. 13). Also each of the four sections can be moved radially inwardly or outwardly by means of a hydraulic cylinder mechanism 220, one end of which is connected to the base plate while the piston rod end is connected to the respective inner lobe portion which can be recessed at 221 to accommodate the end of the cylinder. The inner ends of the inner lobe portions are formed with interlocking fingers in order to allow movement from the extended position shown in FIG. 10 to the retracted position shown in FIG. 12. In an illustrated embodiment, each inner end has two straight interlocking fingers 222 and 224. The manner in which these fingers cooperate is illustrated in FIG. 11. FIG. 11 illustrates the position of the fingers in the retracted position of FIG. 12 when the fingers of adjacent lobes substantially overlap. When the movable sections are extended as shown in FIG. 10 there is only a small overlap between these fingers and, in this position, the fingers form a smooth concave curve for the cam follower track.

Figure 14:
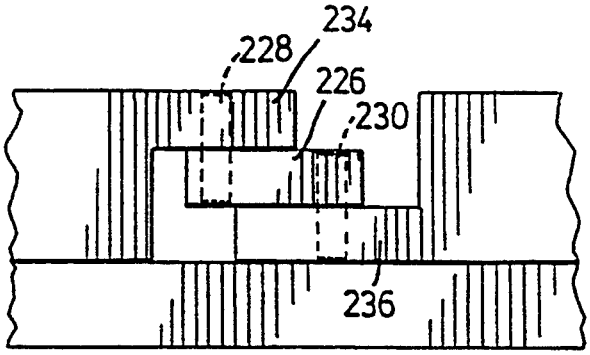
FIG. 14 is a sectional detail taken along the line XIV—XIV of FIG. 10 showing how adjacent outer track lobe sections are joined by a pivotable link.

Each pair of adjacent outer lobe portions 181 to 184 is movably connected by means of a flat link plate 226. The link is pivotally connected to one outer lobe portion by a pin 228 and is pivotally connected to the other outer lobe portion by a further connecting pin 230. The latter pin extends through a slot 232 formed in the link plate. As best seen in FIG. 14, the first pivot pin 228 is connected to an overlapping finger 234 formed on one of the outer lobe portions while the other pin 230 is connected to an underlying finger 236 which is an extension of the other outer lobe portion. When the lobes are retracted to the position shown in FIG. 12, the link members 226 pivot so as to permit the outer lobe portions to come closer together. When the sections are moved to the extended position shown in FIG. 10, each link 226 is pivoted to a position where its curved side 238 acts to keep the outer track continuous.

Figure 15:
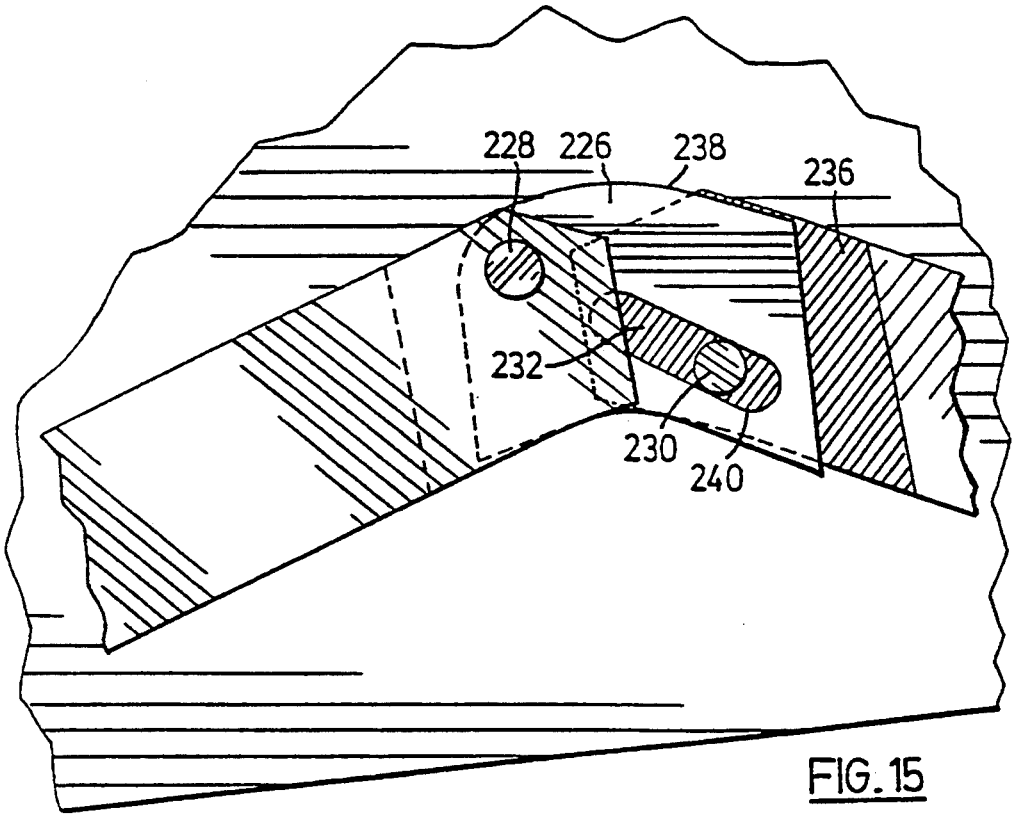
FIG. 15 is a detail view of showing the position of the link when the respective track lobe sections have been retracted a short distance.
Figure 16:
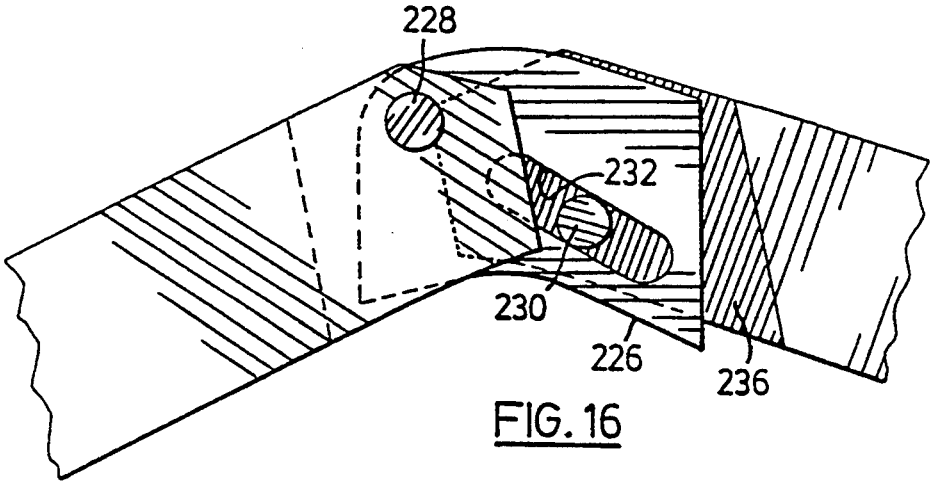
FIG. 16 is a detail view showing the position of the link when the respective track lobe sections have been retracted further from the position of FIG. 15.
Figure 17:
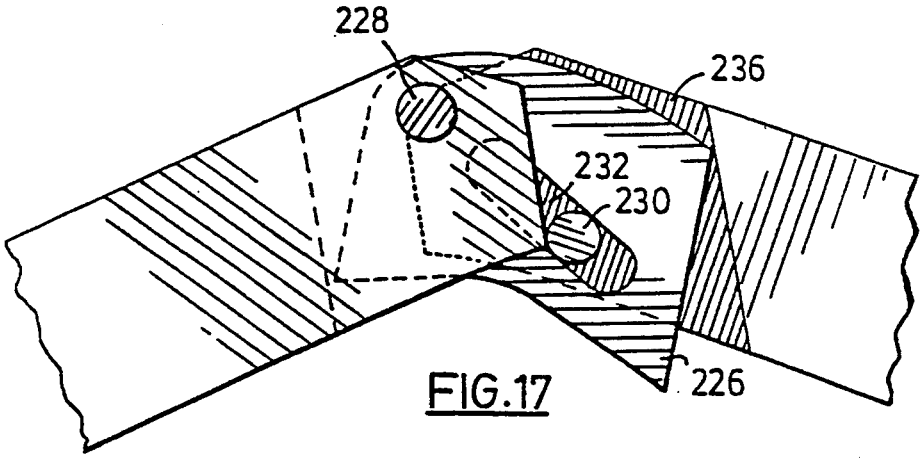
FIG. 17 is another detail view showing the position of the link when the respective track lobe sections have been retracted further from the position of FIG. 16.

The operation of the link 226 is illustrated in FIGS. 15 to 17 of the drawings. FIG. 15 illustrates the position of the link 226 just after the movable sections have been slightly retracted from the position shown in FIG. 10. In this position, the pin 230 is a short distance from the end 240 of its slot. When the movable sections have been retracted further, the pin 230 moves to the middle of slot 232 and the link has rotated to a greater extent in a clockwise direction. In the position shown in FIG. 17, the link member has pivoted substantially above the pin 228 and further rotation will bring it to the position shown in FIG. 12.

It will be understood that the ability to retract the link members and the cutter bits mounted thereon is an advantage in the present continuous mining machine as it permits the machine to be more easily manoeuvred and transported when the boring heads are not in use. For example, it permits easier retraction of the mining machine from the passage that has been bored since the boring head will not take up the complete width or height of the passageway.

The base plate 176 in use is bolted to the front of the gear box 16 of the machine. The rotor shaft extends through the central opening 194 formed in the base plate.

Figure 18:
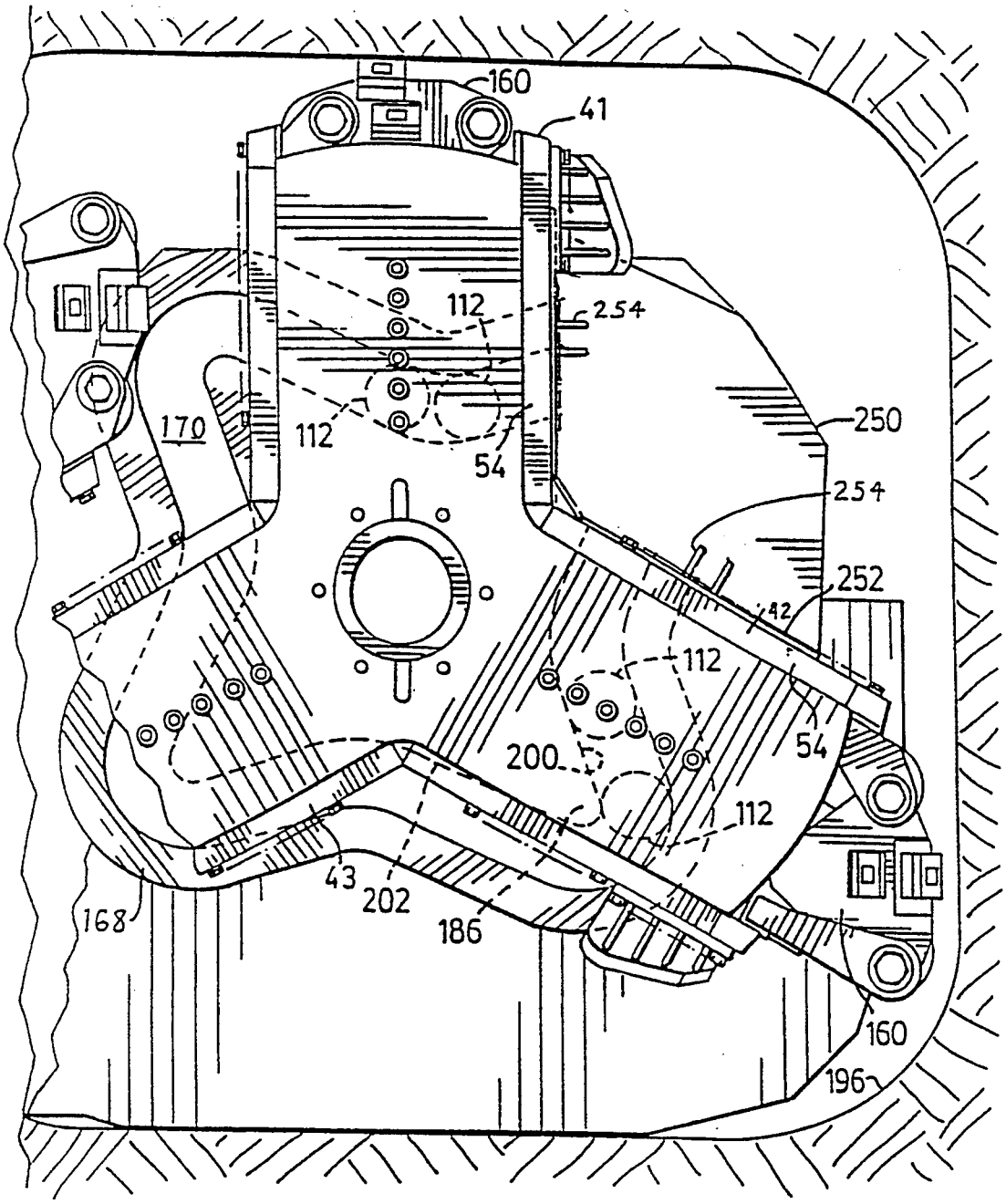
FIG. 18 is a front view of the right hand boring head showing how the track followers move along the lobed track.

FIG. 18 of the drawings illustrates how the track rollers manoeuvre along the four lobed track 170. There is shown in FIG. 18 all three rotor arms 41 to 43. Two link members 160 are also illustrated with the upper link member 160 being fully retracted within its arm and the right hand link member 160 in the process of being extended to cut rounded corner 196 of the bore hole. All six track rollers 112 are indicated in dashed lines. It will be noted that all six are located within the track 170. In the case of the pole devices that are manoeuvring the right hand link member 160, it will be noted that the associated track rollers 112 are ascending a slope 200. When the link member 160 reaches its point of maximum extension, its rollers 112 will straddle the outermost end of the inner lobe section 186. The rollers will then descend down the slope 202 of this slope section, resulting in the respective link member being withdrawn again into the rotor arm as it cuts the final portion of the corner. Note that the cam followers comprising the rollers 112 do not necessarily ride on the inside or the outside of the track when the pole devices are moving either in or out of the respective arm.

FIG. 18 also illustrates a preferred feature of the boring head, namely a guard 250, only one of which is shown for ease of illustration. There are three of these guards, one between each adjacent pair of arms. They can be bolted to the sidewall plates 54 of the arms by means of connecting flanges 252. A couple of brace plates 254 can be used to reinforce the joint between the main plate forming the guard and each flange 252. The guard is mounted at the rear edges of the arms so that it is positioned close to the lobed track of the cam mechanism. The guards help to prevent muck from entering the track as the machine is mining and advancing.

It will be appreciated that there has been described herein an improved mine boring machine which has a number of advantages over known continuous mining machines that employ the usual trim chains. The described mine boring machine will have less maintenance costs in that it avoids the need for trim chains that must operate with extremely high tensions required to draw the cutters through the face. Use of the present mining machine will result in improved machine productivity due to a better penetration rate and fewer stoppages for maintenance and repairs.

Use of the present machine should also result in less dust compared to machines that use trim chains. Because trim chains use a large number of carbide type cutting tips, each of which cuts only about ⅛th of an inch or less as it passes through the face, the known trim chains produce large quantities of dust as well as using a great amount of energy. Far fewer cutting bits are used in the mine boring machine of the invention and these are designed to produce low amounts of dust. Also, the present design should result in a lower noise level produced by the machine because the present design uses rollers that travel along tracks and thus there are fewer areas where metal is impacting or sliding directly on another metal surface as compared to the existing mining machines using trim chains. Mining machine constructed in accordance with the invention should also generate less heat and this can result in improved life for some parts of the machine such as the bearings in the main gear box. Other advantages of a mining machine constructed in accordance with the invention include better bore penetration, less weight on the bore tracks, increased machine availability and improved mobility as compared to existing machines that employ costly trim chains.

It will be appreciated by those skilled in the art that various modifications and changes can be made to the continuous mining machine as described herein without departing from the spirit and scope of this invention. Accordingly, all such modifications and changes as fall within the scope of the invention are intended to be part thereof.

I therefore claim:

1. In a continuous mining machine, a cutter frame, two rotary boring heads mounted on said frame for rotation about axes extending longitudinally of said machine, each boring head having a plurality of radially extending rotor arms which carry and support cutter bits on the front thereof;

a pair of reciprocating pole devices mounted in each of said rotor arms for movement in the radial direction of the arm;

a number of link members each pivotally connected at opposite ends thereof to a respective pair of said pole devices;

additional cutter bits mounted on said link members; and cam means for reciprocating each pair of pole devices as said boring heads are rotated, said cam means causing each pair of pole devices to be pushed radially outwardly at each of four corners distributed about a circular hole cut by the respective boring head in such a manner that the resulting hole bored by said machine is generally rectangular.

2. A continuous mining machine according to claim 1 wherein each pair of pole devices has rollers mounted thereon and each rotor arm has tracks provided therein on which said rollers run.

3. A continuous mining machine according to claim 1 wherein opposite ends of each link member are connected to respective pole devices by connecting pins with the pin member at the trailing end of the link member, relative to the direction of rotation of the rotor arm, extending through a slotted hole formed in the trailing pole device.

4. A continuous mining machine-according to claim 3 wherein each rotor arm has a central channel extending longitudinally thereof, said channel being divided into two elongate channel sections by centrally located wear bars forming said tracks.

5. A continuous mining machine according to claim 4 wherein each rotor arm includes a support plate and two sidewall plates that extend perpendicularly to said support plate and generally radially from a hub of the respective boring head and each sidewall plate has at least one further wear bar mounted on an inner surface thereof, the further wear bars also forming said tracks.

6. A continuous mining machine according to claim 1 wherein said cam means comprises a cam follower mounted on each pole device and a generally flat cam structure having a continuous, four lobe track formed in the front thereof.

7. A continuous mining machine according to claim 1 wherein said boring heads rotate in opposite directions in use and the rotor arms of each head cut said circular hole which overlaps the circular hole cut by the other head.

8. A continuous mining machine according to claim 1 wherein each boring head has three rotor arms extending outwardly from a central hub.

9. A continuous mining machine according to claim 1 wherein each pair of pole devices has two sets of rollers mounted thereon, one set of rollers being rotatable about axes that are perpendicular to the plane of rotation of the respective boring head and the other set being rotatable about axes that are parallel to said plane of rotation of the respective boring head, and each arm has tracks provided therein on which the two sets of rollers run.

10. A continuous mining machine according to claim 9 wherein opposite ends of each link member are connected to respective pole devices by connecting pins mounted on said poles, the connecting pin of the trailing pole device, relative to the direction of rotation of the rotor arm, extending through a slotted hole formed in the respective link member.

11. A continuous mining machine comprising:

a mobile frame;

a longitudinal conveyor mounted on said frame having a forwardly opening throat adjacent the floor level;

a support frame for boring heads mounted on said mobile frame;

at least two rotary boring heads mounted on said support frame so as to rotate about spaced parallel axes in order to cut contiguous bores in advance of said machine, each boring head having at least one rotor arm which carries and supports cutter bits on the front thereof;

a pair of reciprocating poles mounted in each rotor arm for movement in the radial direction of the arm;

link members each pivotally connected at opposite ends thereof to a respective pair of said poles;

cutter bits mounted on each link member;

a cam follower mounted on each reciprocating pole; and a generally flat cam structure mounted on said support frame behind each boring head and having a continuous, lobed track formed in the front thereof, wherein the cam followers move along said track and cause each pair of poles to be pushed radially outwardly at each of several corners distributed about a circular hole cut by the respective boring head in such a manner that the resulting hole bored by said machine has generally flat sides.

12. A continuous mining machine according to claim 11 wherein each pair of poles have rollers mounted thereon and each rotor arm has tracks provided therein on which said rollers run.

13. A continuous mining machine according to claim 12 wherein said opposite ends of each link member are connected to the respective poles by connecting pins mounted on said poles, the connecting pin of the trailing pole, relative to the direction of rotation of the rotor arm, extending through a slotted hole in the respective link member.

14. A continuous mining machine according to claim 13 wherein each rotor arm has a central channel extending longitudinally thereof, said channel being divided into two elongate channel sections by centrally located wear bars forming said tracks.

15. A continuous mining machine according to claim 14 wherein each pole device has four pairs of rollers mounted thereon with the rollers of each pair being axially aligned and spaced apart.

16. A continuous mining machine according to claim 12 wherein each cam follower is a roller rotatably mounted on a rear side of its respective pole.

17. A continuous mining machine according to claim 12 wherein each pole device has four pairs of rollers mounted thereon with the rollers of each pair being axially aligned and spaced apart.

18. A continuous mining machine according to claim 12 wherein each pole device has two pairs of rollers whose axes extend perpendicularly to a front side of the pole device and two further pairs of rollers whose axes are parallel to said front side and perpendicular to the longitudinal axis of the pole device, and the rollers of each and every pair are axially aligned and spaced apart.

19. A continuous mining machine according to claim 11 wherein said track on said support frame has four lobes distributed evenly about the axis of rotation of the respective boring head.

20. A continuous mining machine according to claim 11 wherein each boring head has three rotor arms with each extending at an angle of 120 degrees relative to the other two arms of the boring head.

21. A continuous mining machine according to claim 11 wherein said cam structure includes means for moving sections of said lobed track between an extended position that is assumed during operation of the respective boring head and a retracted position that is assumed during transport of said machine with the boring head not operating.

22. A continuous mining machine according to claim 11 wherein said track on said support frame has four lobes distributed evenly about the axis of rotation of the respective boring head and said cam structure is divided into four movable sections with each of said sections forming one of said four lobes.

23. A continuous mining machine according to claim 22 including hydraulic cylinder means for radially moving each of said four sections inwardly or outwardly, each of said sections having both an inner lobe portion and an outer lobe portion, which portions define opposite sides of said track.

24. A rotary boring head apparatus for a continuous mining or excavating machine comprising:

a central hub, a plurality of radially extending rotor arms connected to said hub and capable of carrying cutter bits on the front thereof, a pair of reciprocating pole devices mounted in each of said rotor arms for movement in the radial direction of the arm;

a number of link members each pivotally connected at opposite ends thereof to a respective pair of said pole devices;

additional cutter bits mounted on said link members; and means for reciprocating each pair of pole devices as said boring head is rotated, said reciprocating means being capable of pushing each pair of pole devices radially outwardly at each of four corners distributed about a circular hole cut by the boring head in such a manner that the resulting hole bored by said machine is generally rectangular.

25. A boring head according to claim 24 wherein said reciprocating means includes a cam structure adapted to be separately mounted behind said rotor arms and a cam follower mounted on each pole device.

26. A boring head according to claim 25 wherein said cam structure includes means for moving sections of said lobed track between an extended position that is assumed during operation of the boring head and a retracted position that is assumed during transport of said machine with the boring head not operating.

27. A boring head according to claim 24 wherein each pair of pole devices has rollers mounted thereon and each rotor arm has tracks provided therein on which said rollers run.

28. A boring head according to claim 27 wherein opposite ends of each link member are connected to respective pole devices by connecting pins with the pin member at the trailing end of the link member, relative to the direction of rotation of the rotor arm, extending through a slotted hole formed in the trailing pole device.

* * * * *